United States Patent [19]

Gardineer et al.

[11] 4,264,693

[45] Apr. 28, 1981

[54] LIGHT AND CURRENT SENSITIVE FILM AND PRINT-DISPLAY SYSTEM THEREWITH

[75] Inventors: Barbara A. Gardineer, Mahopac; Carlos J. Sambucetti, Croton-on-Hudson; Hugo K. Seitz, Putnam Valley, all of N.Y.

[73] Assignee: International Business Machines Corporation, Armonk, N.Y.

[21] Appl. No.: 974,640

[22] Filed: Dec. 29, 1978

[51] Int. Cl.[3] ..... G03G 17/00

[52] U.S. Cl. ..... 430/19; 204/2; 427/121; 427/299; 427/301; 427/343; 427/344; 427/419.1; 428/328; 428/537; 428/913; 430/350; 430/541; 428/432; 428/428; 428/448; 428/450; 428/469; 428/696

[58] Field of Search ..... 427/301, 299, 343, 344, 427/419 R, 419 F, 121, 419.1, 419.7; 346/165; 96/1 E, 68, 85, 86 R; 204/2; 428/913, 539, 537, 328; 430/19, 350, 541

[56] References Cited

U.S. PATENT DOCUMENTS

| | | | |
|---|---|---|---|
| 1,666,329 | 4/1928 | Ferree et al. | 346/165 |
| 2,223,909 | 12/1940 | Elvegard | 96/85 |
| 3,039,871 | 6/1962 | Scott | 96/85 |
| 3,573,958 | 4/1971 | Small | 428/913 |
| 3,713,996 | 1/1973 | Letter | 427/121 |
| 3,764,368 | 10/1973 | Jacobs et al. | 96/68 |
| 3,902,108 | 8/1975 | Sobajma et al. | 346/165 |
| 4,133,933 | 1/1979 | Sekine | 428/328 |

*Primary Examiner*—Ronald H. Smith
*Assistant Examiner*—Janyce A. Bell
*Attorney, Agent, or Firm*—Bernard N. Wiener

[57] ABSTRACT

Films are disclosed which are constituted essentially of iodides of heavy metals to which catalysts or sensitizing agents are added to make the films highly sensitive to light and current at room temperature, thus increasing the speed of writing and erasing cycles. The disclosure provides for producing and erasing images on such light and current sensitive films prepared on substrates such as ordinary paper or transparent non-reactive materials. Marking on the films is achieved by light e.g., laser beam and Xenon lamp, or electrical current. Exemplary erasing is done by application of heat. Several examples are disclosed of the formation of these films adherently on non-reactive surfaces.

18 Claims, 2 Drawing Figures

LIGHT AND CURRENT SENSITIVE FILM AND PRINT-DISPLAY SYSTEM THEREWITH

BACKGROUND OF THE INVENTION

The light sensitive properties of iodide compounds, e.g., lead iodide, have been studied. These materials have been prepared either by dry techniques such as vacuum deposition, or by wet chemical means precipitating the metal iodide from solutions of lead and iodide ions. U.S. Pat. No. 3,764,368 describes lead iodide films with no light sensitivity at room temperature and which work only at temperatures higher than 120° C.; write-erase properties are not described for the films. H. Tolle et al in Applied Physics Letters, Vol. 26, No. 6, pages 349–351 (1975), state that the mechanism of image formation in lead iodide film is such that acceptable images can only be formed at about 180° C. Attempts, with questionable results were made by them to sensitize the marking process by covering the $PbI_2$ film with a pure silver layer and by mixing with organic polymers. The prior art does not disclose the formation of stable images on metal iodide films at room temperature either by light or electrical current and does not disclose the possibility of erasing and rewriting in such films. This has been a limitation on use of the metal iodide film technology, e.g., in the computer industry for computer print-out, display and plotting.

OBJECTS OF THE INVENTION

It is an object of this invention to provide a method of coating metal iodide particles on various substrates so that the light and current sensitive properties of the resulting films can be tailored and controlled by doping trace amounts of catalyst in the film.

Another object of this invention is to provide a film of lead iodide such that ambient light does not affect the film but writing can be done with light at room temperature.

Still another object of this invention is to form lead iodide particles doped with various sensitizing agents to achieve fast marking by light at room temperature together with very long duration of the image.

A further object of this invention is to generate metal iodide particles in a film such that imaging can be done by application of electrical current through the film at room temperature.

Another object of this invention is to provide light and current sensitive metal iodide films such that selective erasing of images therein can be accomplished by heat and the films can be repeatedly reused.

A further general object of this invention is to form adherent films from aqueous suspensions of metal iodide particles on unreactive substrates.

SUMMARY OF THE INVENTION

Films are provided which are constituted essentially of iodides of heavy metals to which catalysts or sensitizing agents are added to make the films highly sensitive to light and current at room temperature, thus increasing the speed of writing and erasing cycles. Practice of the invention provides for producing and erasing images on such light and current sensitive films prepared on substrates such as ordinary paper or transparent non-reactive materials such as glass. Marking on the films is achieved by light, e.g., laser beam and Xenon lamp, or electrical current. Exemplary erasing is done by application of heat. Several examples are disclosed of the formation of these films adherently on unreactive surfaces, such as plastics and polymers (e.g., Mylar, DuPont Trade Name) and glass.

An electrophotographic recording system is disclosed in which light beams, e.g., either from lasers or Xenon lamps, are used to generate a dark image on a thin smooth layer of an iodide compound which is firmly adhered to the recording substrate. Alternatively, the image can be produced by marking electrodes moving along the film. Subsequently, these images can be erased by application of radiant energy such as heat. The marking and erasing cycles can be repeated many times without affecting significantly either the image quality or the appearance of the substrate. The information intelligence for the recording signals may be provided by electronic pulses addressing the laser beams or by electronic pulses directed to a set of writing electrodes in contact with the film. The images thus produced will persist almost indefinitely, until they are to be erased for reuse of the film.

DETAILED DESCRIPTION OF THE DRAWINGS

Figure 1:
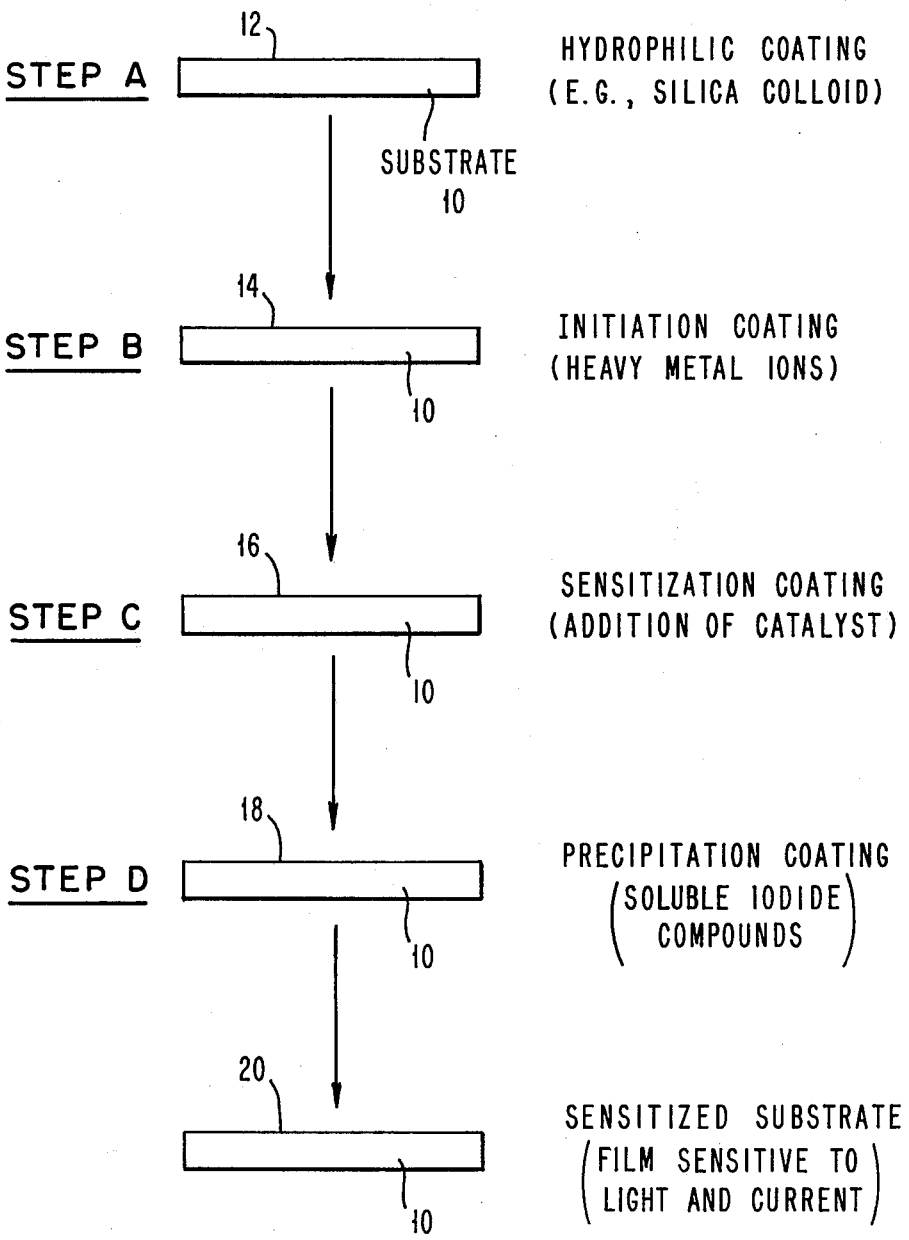
FIG. 1 is a schematic flow chart of the process for coating, sensitizing and generating the films of this invention on substrates.

There is illustrated in the schematic flow chart of FIG. 1 a step by step process for generation of light and electrical current sensitive films in accordance with the principles of this invention. Step A represents the initial substrate 10 activation applied to non-reactive substrates such as Mylar or glass. It involves depositing on the surface 12 a dilute silica colloid, by immersion or spraying for example with a 1% solution of Ludox (DuPont Trade Name) silica, i.e., colloidal solution of silica. The negative charges of this colloid solution adsorb on the unreactive surface 12 and render it hydrophylic, thereby changing the nature of the original unreactive surface and making it compatible for the subsequent steps of the process. The substrate-activation step (A) is essential for the film generation on unreactive substrates such as plastics in general, Mylar or glass in particular. If the substrate 10 has a porous surface 12, e.g., paper, then step (A) is omitted and the process for film generation starts from step (B). Therefore, from step (B) to step (D), the process of film generation is common to various kinds of substrates. Step (B) involves the attachment to the surface 14 of the substrate 10 of ions of heavy metals, such as lead, bismuth or mercury. Step (B) is conveniently carried out by immersing the surface 14 of the substrate or spraying it with a solution of the metal nitrate, for example. In step (C) the surface 16 of the substrate is exposed to a dilute solution containing a catalyst, such as alkali sulfite. Finally, in step (D), the generation of the ultimate film 20 takes place with the formation (by precipitation on the substrate pores or active sites 18) of the metal iodide catalyzed particles. It is carried out by exposing the previously catalyzed surface to a solution containing an organic or inorganic iodide. In this way, finely divided metal iodide particles are generated at the substrate pores 18 or active sites and these become the active sensitive centers of the film 20.

Figure 2:
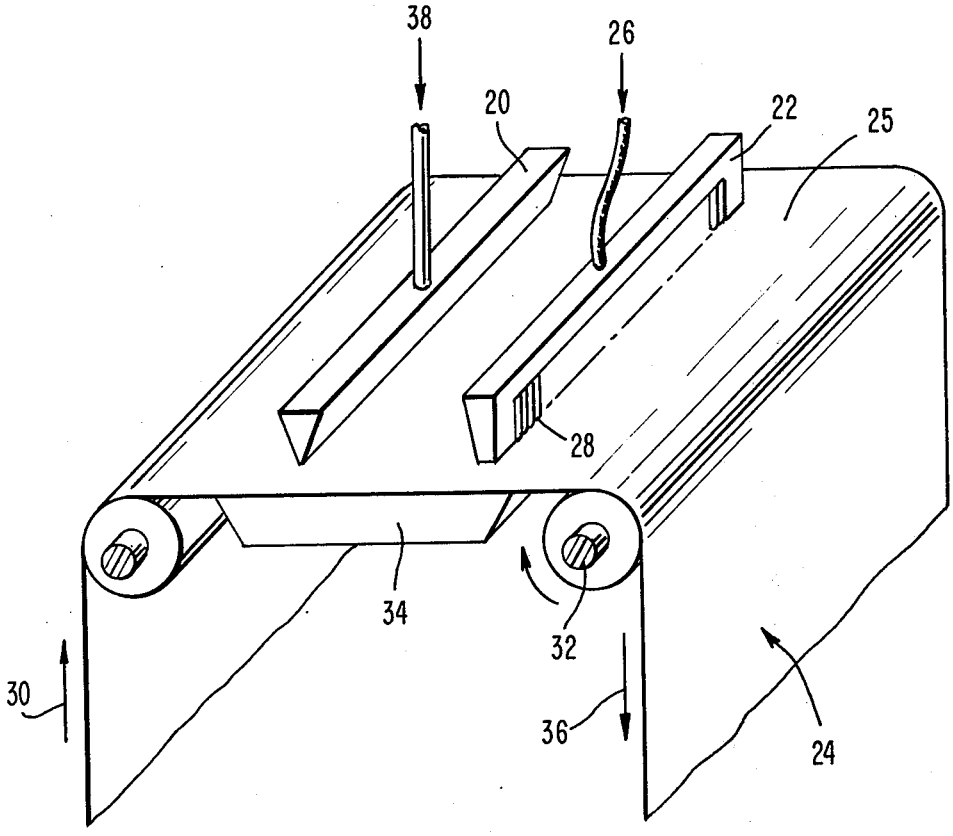
FIG. 2 is a schematic perspective view of a printing system embodying the principles of this invention.

FIG. 2 shows a schematic perspective view of a printing or plotting system based on the principles of the present invention. A wetting device 20 and a writing head 22 are shown mounted contiguously to the recording or printing medium 24, which is the metal iodide film prepared in accordance with the principles of this invention. The apparatus of FIG. 2 is a plotter or printer wherein the recording film of metal-iodide is fed past the marking or writing head 22. The driving mechanism for feeding a continuous sheet of the film is well known in the art and is not shown. In operation of the apparatus of FIG. 2, the paper or recording medium moves from supply 30, past the print head 28 and is collected by paper pick up 32.

A support or platen 34 serves to apply suitable pressure of print head 22 against the paper 24. The character information signals come from the input data source 26, which could be a computer output, a facsimile signal source, a terminal keyboard or some other well known information source. This electronic information is fed in the form of electrical pulses to the electrodes or pulsed light sources 28 of print head 22.

Print head 22 is provided with electrodes 28 in the case of electrical current printing or pulsed light sources 28 when the light sensitivity of the film is utilized to record the incoming information. In electrochemical recording, the surface 25 of the metal iodide film is moistened when passing under the wetting device 20 with a conductive fluid supplied from fluid supply 38. This fluid can be in the form of a solution or in the form of fine droplets or mist. The purpose of the fluid is to make the surface 25 of the film 26 more conductive, and it can be any conductive or electrolyte compound such as ammonium salts. The voltage information pulses arriving from data source 26 into marking members 28 cause electrical current to flow through the metal iodide films to a nearby ground electrode (on the same side or on the backside of the paper) thereby generating marks. The marking members 28 may comprise a series of wires or conductors 28 which are embedded next to the ground electrode in the body of writing head 22. The design of this type of print head is well known in the art and is not shown in detail. Individual dots or lines will be formed under each electrode and on the surface, of the film to form alphanumeric characters, geometric figures or any other desired type of facsimile information.

Similarly, when printing is done using the light sensitivity of the film 24, each marking member 28 of writing head 22 will be formed by a pulsed light source such as semiconductor lasers. These lasers will also generate black marks on the surface 25 of the film 24. The structure and operation of these lasers and other type of light sources are well known in the art. Moisture applied through wetting device 20 will also be beneficial, because moisture increases the speed of printing and the sensitivity to light of metal iodide film 24.

Thus, FIG. 2 illustrates a line printer application with stationary writing head. In serial printer application, the wetting device 20 and writing head 22 are moved across the surface 25 of paper 24, and the paper 24 is advanced one step after the printing of each line.

PRACTICE OF THE INVENTION

In accordance with the principles of the present invention, finely divided metal iodide particles are synthetized by chemical means in situ of the surface of a substrate. The procedure for adherent film formation varies depending on presence or absence of active adsorption sites on the substrate. If the substrate is porous, e.g., paper, porous porcelain, fritted glass, and porous metal surfaces, with fiber-like structures to act as adsorption sites, then the present invention provides for a method of generation of finely divided metal iodide particles, based on stepwise exposure of the substrate to different solutions. An exemplary procedure for sensitizing a substrate is as follows:

1. The initial coating is done by immersing the substrate or spraying it with a solution containing a heavy metal ion $Me^{n+}$:

$$\text{Substrate} + Me^{n+} \rightarrow \text{Substrate}(Me^{n+})$$

This results in an adsorption coated substrate which is subsequently dried.

2. The sensitizing coating is essential for enhancing and controlling the light sensitivity of the film, and is obtained by exposing the adsorption coated substrate of (1) above to a solution containing a catalyst:

$$\text{Substrate}(Me^{n+}) + \text{catalyst} \rightarrow \text{sensitized Substrate}(Me^{n+})$$

Accordingly, the catalyst material is co-adsorbed at the adsorption sites.

3. The precipitation coating is obtained by immersing the sensitized substrate in, or spraying it with, a solution containing a soluble iodide compound. The following film generating reaction takes place at the active sites:

$$Me^{n+} + n\ I^- \rightarrow \text{MeIn(catalyst adsorbed)film}$$

Although it is understood that there may be different sequential steps to carry out the film generation the preferred results regarding film quality and sensitivity to light are obtained by using the above identified sequence.

Among the materials found suitable for the practice of this invention to provide the initial metal ion coating are: soluble heavy metal salts, i.e., salts of lead, mercury, bismuth and tin, of general formula:

$$Me_nA_m$$

where Me is the heavy metal and A is the anion of the soluble salt, which is preferably chloride, nitrate or sulfate, and n and m are positive integers.

The sensitizing coating provides for sensitivity of the film to light at room temperature. It always contains a reducing catalytic substance of ionic nature. Among the materials found suitable for sensitizing the films are sodium sulfite, calcium sulfite and tin chloride. Theoretically, it appears that these ionic impurities are introduced or doped into the crystal lattice of the MeIn, thereby creating lattice imperfections and the crystalline films are less stable to the action of light photons.

Among the materials suitable for the third and final precipitation coating (whereby the film generating reaction is obtained) are soluble inorganic and organic iodides, e.g., alkaline iodides such as sodium, potassium and ammonium iodides, and organic iodides in which the iodide ion is attached to a large organic cation such as acetyl and proyl-choline iodide and tetra-alkyl ammonium iodides such as tryphenylmethyl ammonium-iodide.

In accordance with the present invention, the concentration of heavy metal ions in the initial coating is in the approximate range of 1% to 10% by weight, and is preferably in the approximate range of 2% to 8% by weight. The preferred types of heavy metal salts are lead nitrate and bismuth nitrate and mixtures thereof.

The concentration of the catalyst material in the sensitizing coating provides controlling action to the light sensitivity of the film. Preferred values of concentration are in the approximate range of 0.5% to 5% of catalyst material by weight.

The concentration of iodide salt for the precipitation coating is in the approximate range of 1% to 10% iodide by weight, and is preferably 2 to 8% iodide by weight.

Generation of Films in Unreactive Substrates

With materials such as plastics, Mylar and glass whose surface is poorly wettable and do not provide adsorption sites to the reacting solution, the films obtained are often very spotty and non-uniform. This problem is solved by the procedure now to be described. The surface of the substrate is first activated to create multiple adsorption sites by immersing it in a dilute silica colloid suspension, such as Ludox (DuPont Trade Name), which provides many negatively charged sites on the surface and renders it hydrophylic, e.g., by the following exemplary mechanism:

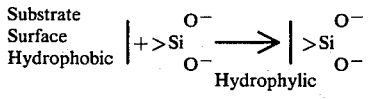

The film is then generated in the same way as described hereinbefore. Thus, there is provided the initial coating with heavy metal ions which adsorb onto the newly created negative sites, e.g., by the following exemplary mechanism:

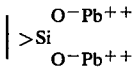

The sensitizing coating with the catalyst salt is then applied. Finally, the film is formed by addition of the soluble iodide compound. Illustratively, smooth films of excellent quality were obtained by the above procedure and showed sensitivity both to light and electrical current writing by a stylus type writing head.

Light Sensitivity of Lead Iodide Film

It has been determined for the practice for this invention that if a common paper substrate, such as bond paper is coated with essentially pure heavy metal iodide, such as lead iodide without catalyst, the system exhibits a fast writing effect with light at room temperature. However, such system is effectively useless because the whole substrate will become dark by the effect of room light. Further, it has also been determined for the practice of this invention if the film of pure lead iodide without catalyst is formed on glass, Mylar or pure cellulose paper, the system is essentially insensitive to light up to approximately 100° C. The reason for the above noted different behaviors of a film of lead iodide is the presence in any normal common paper of traces of sulfite imparted thereto during the paper manufacturing process. In accordance with the principles of the present invention, the light sensitivity of any metal-iodide film can be controlled by the amount of catalyst added to the film in such a way that ambient light does not affect the film but writing can be done at room temperature by a high intensity light, e.g., laser and Xenon lamps with short time exposure, e.g., fractions of a second. It was also discovered for the practice of this invention that moisture exerts an effect on the marking process which enhances the sensitivity of the film.

THEORY FOR THE INVENTION

The effect of sharp increase in light sensitivity by addition to the metal-iodide film of trace amounts of a catalyst, i.e., preferably, sodium or calcium sulfite or tin chloride, can be explained as a catalytic effect promoting the reduction of lead ions in the crystal structure of lead iodide into a reduced black form of lead suboxide as follows:

$$\underset{\text{ion in lead iodide}}{2\,Pb^{++}} + 2H_2O + SO_3^{=} \xrightarrow[h\nu]{\text{light}} SO_4^{=} + 4H^+ + \underset{\text{black mark}}{Pb_2O}$$

These black marks can be erased by raising the temperature of the substrate to about 90° C., either by hot stylus, or steam plus hot stylus combination.

ELECTRICAL WRITING ON FILM OF METAL IODIDE

The above films of heavy metal iodides, in accordance with the present invention, are semiconductors in nature. If a pair of styli electrodes, one positive and the other negative, is applied to the film very little current, e.g., fraction of milliampere, passes through and marking is negligible. This effect can be increased substantially by spraying the film with a conductive solution such as ammonium chloride. The marking effect is then very intense, and occurs with pulses of few milliseconds at voltages of 50 volts. A print head with multiple writing electrodes is suitable to draw characters or pictures on such films using conventional dot matrix printing procedures.

EXAMPLES FOR THE INVENTION

Example 1

An initial coating solution is made by mixing the following materials

| | |
|---|---|
| Lead nitrate | 5gm, |
| Ethanol | 5ml, |
| Water | 90gm. |

The substrate, pure unsized paper strip 3 inch×2 inch×0.002 inch, is first immersed in the above solution and then dried. Next it is immersed in a second sensitizing solution made as follows:

| | |
|---|---|
| Sodium Sulfite | 1gm, |
| Ethanol | 5ml, |
| Water | 94gm. |

After air drying, the sensitize substrate is treated with the following precipitating solution:

| | |
|---|---|
| Ammonium Iodide | 4 gm, |
| Acetylcholine Iodide | 1gm, |
| Ethanol | 5ml, |

-continued

| | |
|---|---|
| Water | 90gm. |

The resulting bright yellow film about 0.001 inch to 0.002 inch thick is firmly adhered to the porous substrate. Printing was done in each of many examples of the above film by exposing it to light at room temperature. Patterns were obtained by interposing stainless steel screen with 4 mil×4 mil holes between light source and the films. Excellent dark marks, without discoloration of the background regions of the film, were obtained by exposure of the film to 655 watt movie light, strobe light of 200 pulses of 2 microseconds and to a 1 watt 5145Å–4888Å laser beams. Erasing was done by heating the films to about 100° C. Many cycles of printing and erasing were achieved on the same films without any appreciable degradation of marking capability thereof.

Example 2

A different film formulation was synthetized by preparing the following solutions:

| | |
|---|---|
| Initial Coating Solution: | |
| Bismuth Nitrate | 3gm, |
| Lead Nitrate | 2gm, |
| Ethanol | 5ml, |
| Water | 90gm. |
| Sensitizing Catalyst Solution | |
| Calcium Sulfite | 0.5g, |
| Ethanol | 5ml, |
| Water | 95gm. |
| Precipitating Solution: | |
| Trimethylphenyl ammonion Iodide | 4gm, |
| Potassium Iodide | 1gm, |
| Ethanol | 5ml, |
| Water | 90gm. |

Generation of the active particles of the film is done in a similar way as in Example 1. The resulting coated substrate is also very sensitive to light at room temperature.

A writing head made of two 10 mil diameter platinum electrodes, pulsed at 50 volts, 2 millisecond, was moved over the film of Example 2 at 5 inch per second Excellent black dot patterns were generated when the substrate is slightly moist with 10% solution of ammonium chloride.

Example 3

Example 3 demonstrates adherent particle generation in hydrophobic substrates. This example applies to substrate which are generally unwettable by aqueous solutions, and possess very weak adsorption sites. Samples of the substrates (Mylar, glass, plastics in general) are first treated as follows:

(a) In solution of isopropyl alcohol in ultrasonic bath for 5 min.

(b) Immersed in silica colloid (such as Ludox (DuPont Trade Mark) 1% by weight) for 2 min. Next samples are dryed in oven at 70° C.

(c) The activated surfaces are then exposed in the same sequence to the 3 coating solutions of Examples 1 and 2.

Very smooth, adherent films are obtained. These films show good sensitivity to light as for Example 1 and to electrical current marking as for Example 2.

Having thus described our invention, what we claim as new, and desired to secure by Letters Patent is:

1. A method for synthesizing catalyzed heavy-metal iodide particles in a film adhered to a porous substrate comprising the steps of:

forming a first adsorption coating on said substrate of ions of heavy metals by immersing the surface of said substrate in a solution of said ions or spraying said surface with said solution, said heavy metal coating comprising a specie selected from the group consisting of lead, bismuth, mercury and tin, and mixtures thereof, forming a second sensitizing coating made of ionic catalyst by exposing said first coating to a dilute solution of said catalyst, said ionic sensitizing catalyst coating being selected from the group consisting of reducing sulfites, and forming a third precipitating coating using soluble iodide materials which establishes an insoluble compound with metal ions of said first coating by exposing said second coating to a solution containing said iodide materials, said soluble iodide materials being selected from the group consisting of alkali iodides, ammonium iodide, and tetraalkylammonium iodides.

2. The method of claim 1 wherein the substrate is a porous structure possessing multiple adsorption sites.

3. The method of claim 2 wherein said substrate comprises a surface selected from the group consisting of unsized-paper and porous metal.

4. The method of claim 1 wherein said sulfite is selected from the group consisting of lead-sulfite, bismuth-sulfite, mercury-sulfite, tin-sulfite, sodium-sulfite, calcium-sulfite, alkali metal sulfites, and mixtures thereof.

5. The method of claim 1 wherein said tetraalkylammonium iodides have the general formula

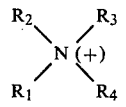

in which $R_1$, $R_2$, $R_3$ and $R_4$ are alkyl phenyl groups either simple or substituted.

6. The method of claim 5 wherein said alkyl-phenyl groups are selected from the group consisting of trimethylphenyl ammonium, and acetylcholine.

7. A method for writing and erasing information in a film adhered to a porous substrate wherein said film is comprised of particles selected from the group consisting of lead-iodide, mercury-iodide and tin-iodide with sulfite catalyst dispersed therein, comprising the steps of:

illuminating said film by a light source to create an image therein, and heating said film to erase said created image.

8. A method for writing and erasing information in a film adhered to a porous substrate wherein said film is comprised of particles selected from the group consisting of lead-iodide, mercury-iodide and tin-iodide with sulfite catalyst dispersed therein comprising the steps of:

marking information on said film by electrodes in contact with the surface thereof by electrical pulses, and heating said marked film to erase said information.

9. A method for synthesizing catalyst heavy-metal iodide particles in a film adhered to an unreactive non-porous substrate comprising the steps of:

treating initially the surface of said substrate by immersing it in a negative colloid or spraying it with a negative colloid which adsorbs on the surface and changes its structure, forming a first adsorption coating on said treated substrate by ions of heavy metals by immersing the surface of said substrate in a solution of said ions or spraying said surface with said solution, said heavy metal coating comprising a specie selected from the group consisting of lead, bismuth, mercury and tin, and mixtures thereof, forming a second sensitizing coating made of ionic catalyst by exposing said first coating to a dilute solution of said catalyst, said ionic sensitizing catalyst coating being selected from the group consisting of reducing sulfites, and forming a third precipitating coating using soluble iodide materials which establishes an insoluble compound with metal ions of said first coating by exposing said second coating to a solution containing said iodide materials, said soluble iodide materials being selected from the group consisting of alkali-iodides, ammonium-iodide, and tetraalkylammonium.

10. The method of claim 9 wherein said negative colloid is a dilute silica suspension.

11. The method of claim 9 wherein said sulfite is selected from the group consisting of lead-sulfite, bismuth-sulfite, mercury-sulfite, tin-sulfite, sodium-sulfite, calcium-sulfite, alkali-metal sulfites, and mixtures thereof.

12. The method of claim 9 wherein said tetraalkylammonium iodides have the general formula

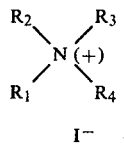

in which $R_1$, $R_2$, $R_3$ and $R_4$ are alkyl phenyl groups either simple or substituted.

13. The method of claim 12 wherein said alkyl-phenyl groups are selected from the group consisting of trimethylphenyl ammonium, and acetylcholine.

14. The method of claim 9, wherein said substrate is selected from the group consisting of transparent plastic, polymer and glass.

15. A film adhered to a porous substrate selected from the group consisting of paper, porcelain, glass and metal wherein said film is comprised of particles selected from the group consisting of lead-iodide, mercury-iodide and tin-iodide with sulfite catalyst dispersed therein, said sulfite being selected from the group consisting of lead-sulfite, bismuth-sulfite, mercury-sulfite, tin-sulfite, sodium-sulfite, calcium-sulfite, alkali-sulfites, and mixtures thereof.

16. A film adhered to an unreactive non-porous substrate selected from the group consisting of plastic, polymer, and glass via a layer of negative silica colloid wherein said film is comprised of particles selected from the group consisting of lead-iodide, mercury-iodide and tin-iodide with sulfite catalyst dispersed therein, said sulfite being selected from the group consisting of lead-sulfite, bismuth-sulfite, mercury-sulfite, tin-sulfite, sodium-sulfite, calcium-sulfite, alkali-sulfites, and mixtures thereof.

17. A film adhered to a porous substrate selected from the group consisting of paper, porcelain, glass, and metal wherein said film is comprised of particles selected from the group consisting of lead-iodide, mercury-iodide and tin-iodide with tin-chloride catalyst dispersed therein.

18. A film adhered to an unreactive non-porous substrate selected from the group consisting of plastic, polymer, and glass via a layer of negative silica colloid wherein said film is comprised of particles selected from the group consisting of lead-iodide, mercury-iodide and tin-iodide with tin-chloride catalyst dispersed therein.

* * * * *